US011282655B2

(12) United States Patent
Sato et al.

(10) Patent No.: US 11,282,655 B2
(45) Date of Patent: Mar. 22, 2022

(54) SWITCH DEVICE FOR PREVENTING ELECTRICAL CONTACT FAILURE

(71) Applicant: ALPS ALPINE CO., LTD., Tokyo (JP)

(72) Inventors: Hidetaka Sato, Miyagi (JP); Takaya Sakamoto, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/242,687

(22) Filed: Apr. 28, 2021

(65) Prior Publication Data

US 2021/0249202 A1 Aug. 12, 2021

Related U.S. Application Data

(63) Continuation of application No. PCT/JP2019/041338, filed on Oct. 21, 2019.

(30) Foreign Application Priority Data

Oct. 31, 2018 (JP) ..... JP2018-205096

(51) Int. Cl.
*H01H 13/06* (2006.01)
*H01H 13/52* (2006.01)

(52) U.S. Cl.
CPC ..... *H01H 13/06* (2013.01); *H01H 13/52* (2013.01); *H01H 2215/004* (2013.01)

(58) Field of Classification Search
CPC .. H01H 13/06; H01H 13/52; H01H 2215/004; H01H 3/12; H01H 5/00;
(Continued)

(56) References Cited

U.S. PATENT DOCUMENTS 10,068,723 B2 9/2018 Oyamada et al.
2006/0060458 A1* 3/2006 Meagher ..... H01H 13/06 200/61.73

(Continued)

FOREIGN PATENT DOCUMENTS

JP S61-022517 1/1986
JP 2015-222660 12/2015

(Continued)

OTHER PUBLICATIONS

International Search Report for PCT/JP2019/041338 dated Jan. 21, 2020.

*Primary Examiner* — Edwin A. Leon
*Assistant Examiner* — Iman Malakooti
(74) *Attorney, Agent, or Firm* — IPUSA, PLLC

(57) ABSTRACT

A switch device includes a housing including a recessed portion, a metal member, and a movable contact point member. The recessed portion is recessed in a thickness direction from an opening formed in a first surface. The metal member includes a terminal protruding from the housing, a fixed contact point exposed to an inner side of the recessed portion, and a connection portion connecting the terminal and the fixed contact point. The movable contact point member is provided in the recessed portion and is configured to move to connect to or disconnect from the fixed contact point. A sealing unit is provided in a gap between the connection portion and the housing. The sealing unit is made by solidifying a sealing agent supplied through a hole portion that is in communication with the connection portion from a second surface opposite to the first surface of the housing.

6 Claims, 5 Drawing Sheets

(58) Field of Classification Search
CPC ..... H01H 5/04; H01H 13/26; H01H 13/48; H01H 13/063; H01H 9/04; H01H 9/041
USPC ..... 200/302.1, 302.2, 402–409, 468
See application file for complete search history.

(56) References Cited

U.S. PATENT DOCUMENTS

| | | | | |
|---|---|---|---|---|
| 2015/0179367 | A1 | 6/2015 | Kodama et al. | |
| 2017/0229258 | A1* | 8/2017 | Oyamada ..... | H01H 13/04 |

FOREIGN PATENT DOCUMENTS

| | | |
|---|---|---|
| JP | 2016-027533 | 2/2016 |
| WO | 2016/059872 | 4/2016 |

* cited by examiner

SWITCH DEVICE FOR PREVENTING ELECTRICAL CONTACT FAILURE

CROSS-REFERENCE TO RELATED APPLICATION

The present application is a continuation application filed under 35 U.S.C. 111 (a) claiming benefit under 35 U.S.C. 120 and 365 (c) of PCT International Application No. PCT/JP2019/041338 filed on Oct. 21, 2019 and designating the U.S., which claims priority to Japanese Patent Application No. 2018-205096 filed on Oct. 31, 2018. The entire contents of the foregoing applications are incorporated herein by reference.

BACKGROUND OF THE INVENTION

1. Field of the Invention

The present disclosure relates to a switch device.

2. Description of the Related Art

For example, Japanese Laid-Open Patent Publication No. 2015-222660 discloses a push switch including: a case including a movable contact point member, a recessed space which can contain the movable contact point member and one side of which is an opening, a fixed contact point portion capable of coming into contact with the movable contact point member being integrally formed by insert molding in the recessed space; and a covering member attached to an upper surface of the case so as to cover the opening, wherein the case includes a retention portion formed in a recessed shape on a lower surface, wherein the retention portion includes a bottom surface portion formed to face downward, wherein the bottom surface portion includes a protruding portion protruding downward, and a pressing hole, from which a portion of the fixed contact point portion is exposed, at a position that is along an inner side wall of the retention portion and that is higher than the protruding portion, wherein an inclined portion inclined from the protruding portion to the pressing hole is formed between the protruding portion and the pressing hole, and wherein the pressing hole is sealed with a sealing resin that is filling the retention portion and is cured.

SUMMARY OF THE INVENTION

However, with such a conventional push switch (switch device), foreign substances can be prevented or inhibited from entering the pressing hole to the fixed contact point portion by sealing the pressing hole with the sealing resin, but it used to be difficult to prevent or inhibit foreign substances from entering the fixed contact point portion through a gap between the case and the terminal that is connected to the fixed contact point portion and that is protruding to the outside of the case. When foreign substances attach to the fixed contact point portion, there is a possibility that an electrical contact failure occurs.

Accordingly, it is an object of the present disclosure to provide a switch device that prevents or inhibits the occurrence of failures of an electrical contact due to entry of foreign substances.

A switch device according to an embodiment of the present disclosure includes:

a housing including a first surface and a second surface, the second surface formed on an opposite side of the housing from the first surface, the housing including a recessed portion recessed in a thickness direction from an opening formed in the first surface;

a metal member provided in the housing by insert molding, the metal member including a terminal protruding to an outside from a first end portion of the housing, a fixed contact point exposed to an inner side of the recessed portion, and a connection portion connecting the terminal and the fixed contact point;

a movable contact point member contained in the recessed portion and configured to move to connect to or disconnect from the fixed contact point, wherein the second surface of the housing is formed with a hole portion that is in communication with the connection portion, and a sealing unit is provided in a gap between the connection portion and the housing, and the sealing unit is made by solidifying a sealing agent supplied through the hole.

According to an embodiment of the present disclosure, a switch device that prevents or inhibits the occurrence of failures of an electrical contact due to entry of foreign substances can be provided.

DETAILED DESCRIPTION OF THE PREFERRED EMBODIMENT

Hereinafter, an embodiment to which a switch device according to the present disclosure is applied will be described.

Embodiment

Figure 1:
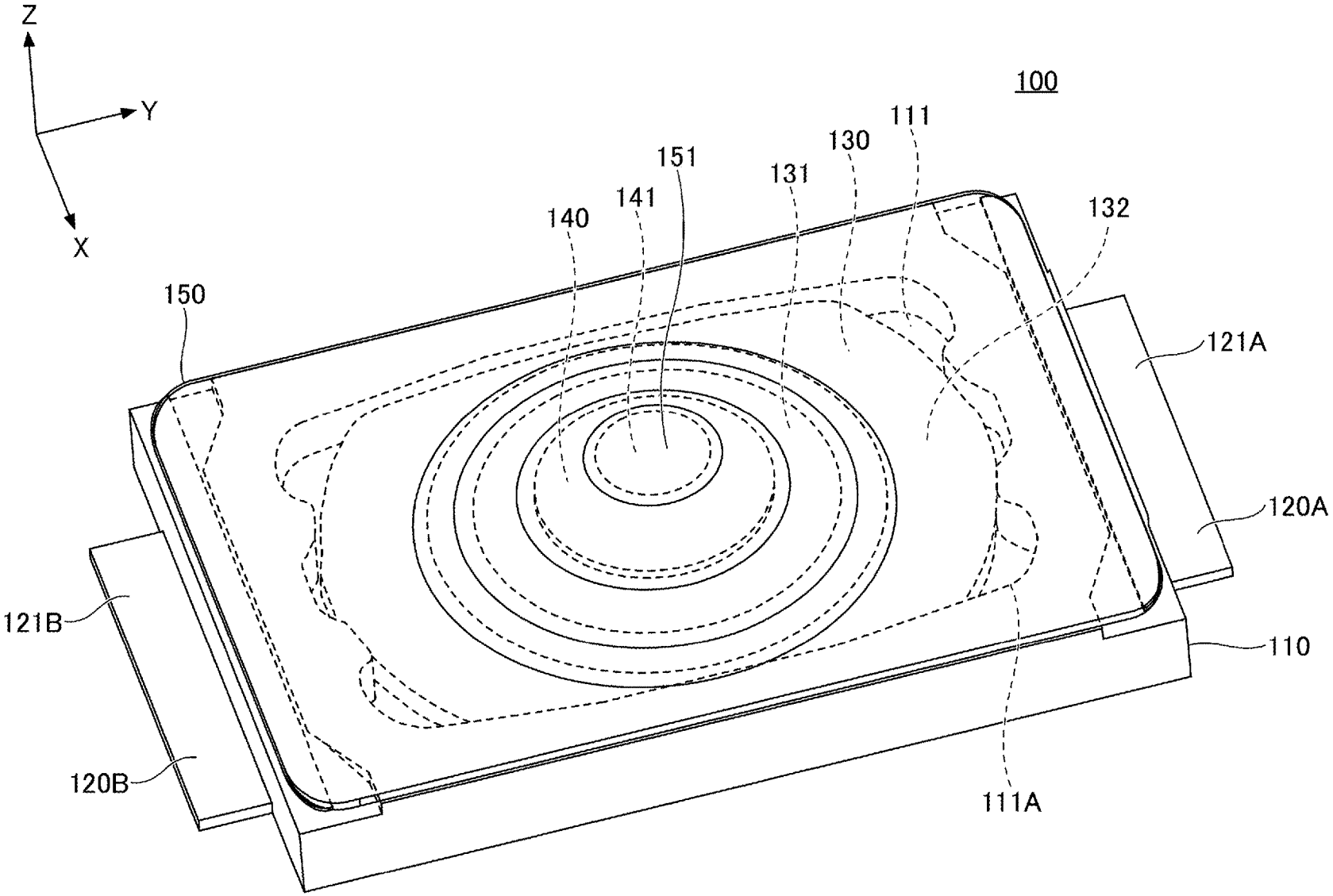
FIG. 1 is a perspective view illustrating a switch device 100 according to an embodiment.
Figure 2:
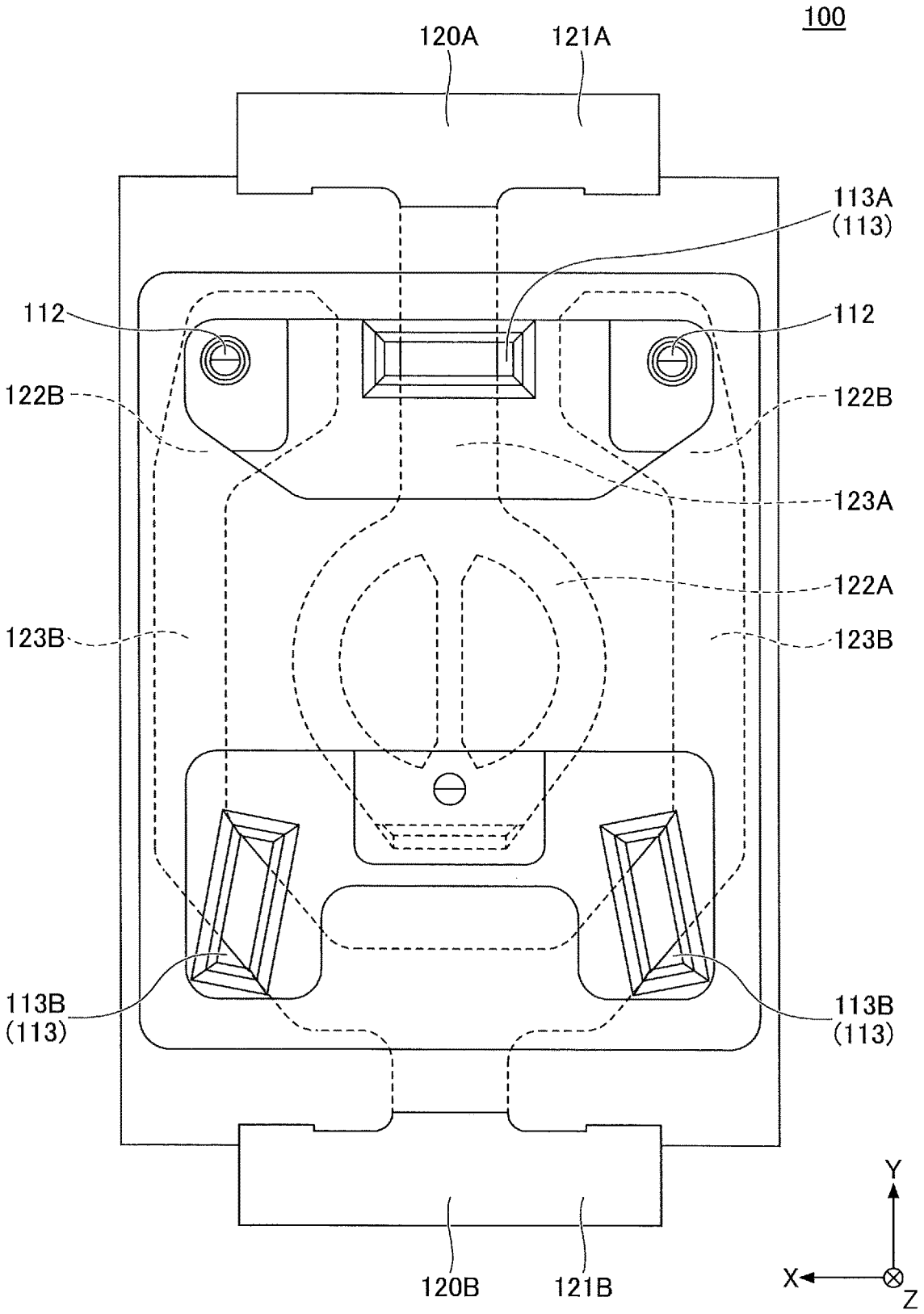
FIG. 2 is a drawing illustrating a lower surface (a bottom surface) side of the switch device 100.

FIG. 1 is a perspective view illustrating the switch device 100 according to the embodiment. FIG. 2 is a drawing illustrating a lower surface (a bottom surface) side of the switch device 100. Hereinafter, the explanation is made with reference to an XYZ coordinate system. Also, hereinafter, for the sake of convenience, a negative side in the Z axis direction is referred to as a lower side or down, and a positive side in the Z axis direction is referred to as an upper side or up, but they do not necessarily represent an absolute arrangement in the vertical direction. A plan view means a top view illustrating the XY plane as seen from the Z axis direction.

As illustrated in FIG. 1, the switch device 100 includes the housing 110, metal plates 120A, 120B, a metal contact 130, a stem 140, and an insulator 150. The switch device 100 is a push switch.

Figure 3:
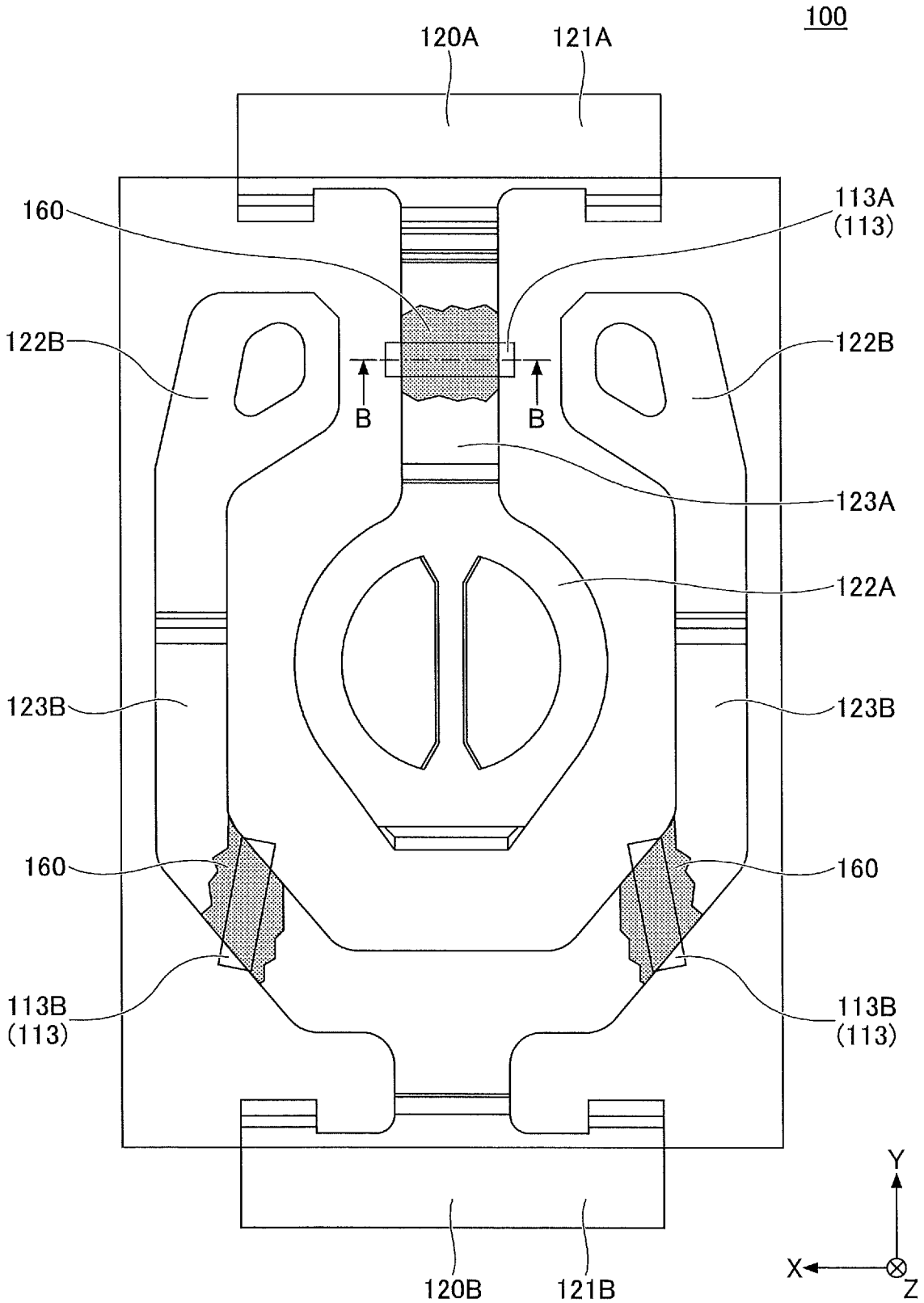
FIG. 3 is a drawing transparently illustrating, from a bottom surface side, an arrangement of a housing 110 and a metal plate 120.

FIG. 1 transparently illustrates the insulator 150, and transparently illustrates the entirety or portions of the metal plates 120A, 120B, the metal contact 130, and the stem 140 arranged under the insulator 150. The insulator 150 may be transparent or semi-transparent, but does not have to be transparent. Hereinafter, the explanation is made with reference to not only FIG. 1 and FIG. 2 but also FIG. 3. FIG. 3 is a drawing transparently illustrating, from the bottom surface side, the arrangement of the housing 110 and the metal plate 120.

The housing 110 is made of resin, and is a plate-shaped member (a casing) of which the length in the Y axis direction is longer than the length in the X axis direction and which has a thickness in the Z axis direction. The upper surface of the housing 110 is an example of a first surface, and the lower surface is an example of a second surface.

The housing 110 has a recessed portion 111 depressed in the thickness direction from an opening 111A on the upper surface. An insulator 150 is bonded to the upper surface of the housing 110. Also, the housing 110 is integrally made with metal plates 120A, 120B by insert molding.

In the recessed portion 111, a center fixed contact point 122A of the metal plate 120A and peripheral fixed contact points 122B of the metal plate 120B are exposed on the bottom surface of the recessed portion 111. Also, the metal contact 130 and a portion of the stem 140 are contained in the recessed portion 111. The center fixed contact point 122A of the metal plate 120A, the peripheral fixed contact points 122B of the metal plate 120B, the metal contact 130, and the stem 140 are held in an overlapping state in the space enclosed by the recessed portion 111 and the insulator 150.

Note that the housing 110 includes not only the recessed portion 111 but also openings 112, 113A, 113B formed in the lower surface, which will be explained later.

The metal plate 120A includes a terminal 121A, the center fixed contact point 122A, and a connection portion 123A. The terminal 121A protrudes from an end portion at the positive side in the Y axis direction of the housing 110 to the positive side in the Y axis direction, and is connected to an external circuit and a device. The center fixed contact point 122A is arranged in the recessed portion 111, and is a portion that come into contact with a dome portion 131 of the metal contact 130 when the dome portion 131 of the metal contact 130 is operated to be inverted. The connection portion 123A is an arm-shaped portion that connects the terminal 121A and the center fixed contact point 122A, and is a portion covered with the resin of the housing 110 produced by insert molding.

The metal plate 120A is an example of a metal member made by processing a sheet metal made of metal such as copper by a punch process and the like. The upper surface and lower surface of the metal plate 120A that are parallel to the XY plane are smooth. The side surfaces of the metal plate 120A (surfaces parallel to the Z axis) are fracture surfaces that are cut by a punch process and the like. Therefore, the side surfaces of the metal plate 120A have more unevenness than the upper surface and the lower surface.

The metal plate 120B includes a terminal 121B, the two peripheral fixed contact points 122B, and two connection portions 123B. The terminal 121B protrudes from an end portion at the negative side to the positive side in the Y axis direction of the housing 110, and is connected to an external circuit and a device. The peripheral fixed contact points 122B are provided in the recessed portion 111, and are portions that are in contact with a peripheral portion 132 of the metal contact 130. The connection portions 123B are arm-shaped portion that connects the terminal 121B and the peripheral fixed contact points 122B, and are portions covered with the resin of the housing 110 produced by insert molding.

The metal plate 120B is an example of a metal member made by processing a sheet metal made of metal such as copper by a punch process and the like, similarly with the metal plate 120A. Therefore, the upper surface and lower surface of the metal plate 120B that are parallel to the XY plane are smooth, and the side surfaces of the metal plate 120B have more unevenness than the upper surface and the lower surface.

The metal contact 130 is constituted by a metal leaf spring made of a material that is elastic and conductive, and is located in the recessed portion 111. The metal contact 130 includes the dome portion 131 in a bulging form and the peripheral portion 132 around the dome portion 131.

The dome portion 131 has a shape that bulges toward the positive side in the Z axis direction in a dome shape, and has a circular shape in a XY plan view. The shape of the dome portion 131 allows it to be operated so that its bulging direction can be inverted with respect to the peripheral portion 132 according to the pressing operation from the bulging direction (the positive side in the Z axis direction). The dome portion 131 is sufficiently elastic so that, when the pressing force is released, the dome portion 131 returns back to the shape in direction of the original bulging shape.

In both of the state in which the dome portion 131 is not inverted and in the state in which the dome portion 131 is inverted, the peripheral portion 132 can obtain an electrically conductive state with the peripheral fixed contact points 122B by being in contact with the peripheral fixed contact points 122B of the metal plate 120B.

When a protruding portion 151 is pushed and the dome portion 131 is inverted, the dome portion 131 comes into contact with the center fixed contact point 122A of the metal plate 120A to bring the center fixed contact point 122A and the peripheral fixed contact points 122B to be in contact with each other.

For example, the stem 140 is made of resin, and is an example of a push member. The stem 140 has a circular shape in the plan view in the XY plane, and has a shape protruding in a dome shape toward the positive side in the Z axis direction. A top portion 141 of the stem 140 is aligned with the positions of the dome portion 131 of the metal contact 130 and the protruding portion 151 of the insulator 150 in the plan view in the XY plane. The lower surface of the stem 140 is in contact with the dome portion 131, and the top portion 141 of the stem 140 is in contact with the protruding portion 151.

The stem 140 configured as described above is interposed between the metal contact 130 and the insulator 150, so that, when the protruding portion 151 of the insulator 150 is pressed, the protruding portion 151 of the insulator 150 is configured to press the metal contact 130 via the stem 140, whereby the center of the metal contact 130 can be reliably pressed.

The insulator 150 is constituted by a resin sheet, and is bonded to the upper surface of the housing 110 to seal the recessed portion 111. In this manner, the insulator 150 is fixed to the upper surface of the housing 110. The sealing between the housing 110 and the insulator 150 satisfies a predetermined weathertightness. The insulator 150 is an example of a cover sheet.

The insulator 150 has a protruding portion 151 at a position overlapping with the upper portion 131A of the stem 140 in the plan view. The protruding portion 151 is formed by processing the resin sheet by heat.

While the center fixed contact point 122A, the peripheral fixed contact points 122B, the metal contact 130, and the stem 140 are contained in the recessed portion 111 of the housing 110, the insulator 150 is bonded to the housing 110. Because the insulator 150 is bonded to the housing 110, the metal contact 130 is in a slightly pressed state, and therefore, due to this repulsive force, the metal contact 130 and the stem 140 is held rigidly in the recessed portion 111.

The protruding portion 151 is arranged at a position overlapping with the upper surface of the top portion 141 of the stem 140 in the plan view, and is in contact with the upper surface of the top portion 141. When the protruding portion 151 is pressed toward the negative side in the Z axis direction, the protruding portion 151 can bend and deform to the negative side in the Z axis direction, and when the protruding portion 151 is not bent and deformed, the protruding portion 151 is in contact with the upper surface of the top portion 141.

Next, the openings 112, 113A, 113B of the housing 110 are explained with reference to FIG. 2 and FIG. 3.

The openings 112 are holes in which jigs for holding the metal plates 120A, 120B when the housing 110 and the metal plates 120A, 120B are integrally formed by insert molding. The openings 112 are sealed with sealing resin when the jigs have been removed after the insert molding is performed.

The openings 113A, 113B are arranged at positions overlapping with the connection portions 123A, 123B, respectively. Inserts used to produce the openings 113A, 113B by insert molding may be give the function of the jig for holding the metal plates 120A, 120B, respectively.

The openings 113A, 113B have openings of such sizes as to expose both ends in the width directions of the connection portions 123A, 123B, respectively. In this case, both ends in the width directions of the connection portions 123A, 123B mean both ends in a direction having an angle (an angle larger than zero degree) in the plan view in the XY plane with respect to the direction in which the connection portion 123A extends to connect the terminal 121A and the center fixed contact point 122A.

In other words, both ends in the width direction of the connection portion 123A are not limited to both ends in a direction perpendicular, in the plan view in the XY plane, to the direction in which the connection portion 123A extends, and may include both ends in a direction diagonal to the direction in which the connection portion 123A extends.

When the housing 110 and the metal plates 120A, 120B are integrally produced by insert molding, a very small gap may occur between the housing 110 and the metal plates 120A, 120B, because resin and metal have different shrinkage rates. In particular, the side surfaces of the metal plates 120A, 120B are fracture surfaces with a lower degree of smoothness, and therefore, the gap is likely to become larger.

The terminals 121A, 121B are connected to other circuits and devices by solder. As a result, a flux, an additive for soldering, enters the gap between the terminals 121A, 121B and the housing 110, and may reach the center fixed contact point 122A and the peripheral fixed contact points 122B through the gap between the connection portions 123A, 123B and the housing 110.

Therefore, in the switch device 100, a sealing agent is injected through the openings 113A, 113B with openings of such sizes as to expose both ends in the width directions of the connection portions 123A, 123B, and accordingly; the sealing agent fills the gap between the connection portions 123A, 123B exposed through the openings 113A, 113B and portions therearound and the gap between them and the housing 110. The injected sealing agent is solidified (cured) to be made into a sealing unit 160 as illustrated in FIG. 3.

The sealing agent may be a potting liquid that has a high degree of pervasiveness during application and accordingly achieves a high degree of waterproofness after the application. When the amount of liquid and the like are adjusted so that the potting liquid permeates not only the lower surfaces and the side surfaces but also the upper surfaces of the connection portions 123A, 123B, the sealing unit 160 can cover, around the connection portions 123A, 123B exposed from the openings 113A, 113B and portions therearound, the gap between the housing 110 and the entire surfaces of the lower surfaces, the both side surfaces, and the upper surfaces of the connection portions 123A, 123B. In other words, around the connection portions 123A, 123B exposed from the openings 113A, 113B and portions therearound, the sealing unit 160 can be formed on the entire periphery of the connection portions 123A, 123B so as to fill the gap with the housing 110.

The viscosity of the potting liquid is, for example, about 100 mPa·S to 2000 mPa·S. Also, the gap between the connection portions 123A, 123B and the housing 110 is, for example, equal to less than 10 μm.

In the manner as described above, the flux is prevented or inhibited from entering the gap on the side closer to the center fixed contact point 122A and the peripheral fixed contact points 122B than the connection portions 123A, 123B exposed from the openings 113A, 113B and portions therearound.

FIG. 4A to FIG. 4D are drawings illustrating cross-sectional structure of the sealing unit 160. Hereinafter, the connection portion 123A exposed from the opening 113A is explained, but the connection portion 123B exposed from the opening 113B is configured similarly.

Figure 4A:
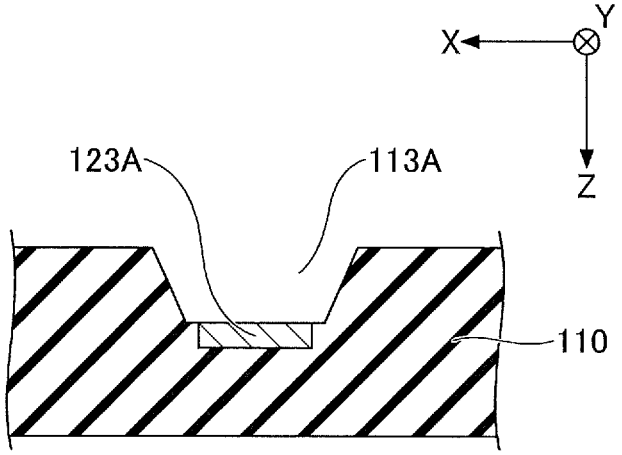
FIG. 4A is a drawing illustrating a cross-sectional structure of a sealing unit 160.

FIG. 4A illustrates a cross-sectional view taken along a line indicated by arrows B-B in FIG. 3. The surface (the lower surface) of the connection portion 123A is exposed from the opening 113A. The opening 113A has a wider opening than the width of the connection portion 123A. Therefore, on both sides of the connection portion 123A, there are flat portions of the housing 110 formed to have the same height as the upper surface of the connection portion 123A. In this manner, the width of the opening 113A is larger than the width of the connection portion 123A, so that even though the positions of the inserts for producing the opening 113A by insert molding vary in the width direction, both ends in the width direction of the connection portion 123A can be reliably exposed from the opening 113A, and the potting liquid can reliably permeate both side surfaces in the direction of the width of the connection portion 123A.

Figure 4B:
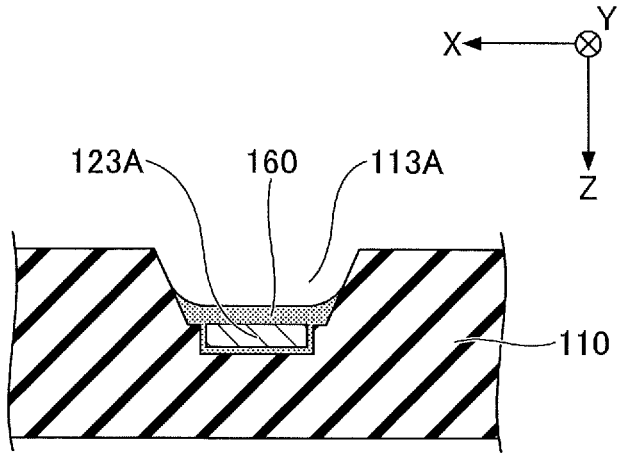
FIG. 4B is a drawing illustrating a cross-sectional structure of the sealing unit 160.

When the potting liquid is injected from the opening 113A, the sealing unit 160 is formed on the entire periphery of the connection portion 123A as illustrated in FIG. 4B. As a result, the flux can be prevented or inhibited from entering the gap on the side closer to the center fixed contact point 122A than the portion covered with the sealing unit 160.

Alternatively, the sealing unit 160 does not have to be formed on the upper surface of the connection portion 123A, and instead, the sealing unit 160 may be formed only from the lower surface to both side surfaces. This is because the upper surface is smoother than both side surfaces, and accordingly, the gap between the upper surface and the housing 110 is smaller than the gap between both side surfaces and the housing 110, so that it is difficult for the flux to enter the gap between the upper surface and the housing 110.

Still alternatively, the sealing unit 160 does not have to be formed even on both side surfaces of the connection portion 123A, and instead, the sealing unit 160 may be formed only on the lower surface. This is because, when the sealing unit 160 is formed at least on the lower surface, it is at least more difficult for the flux to enter the gap than when the sealing unit 160 is not provided at all.

Figure 4C:
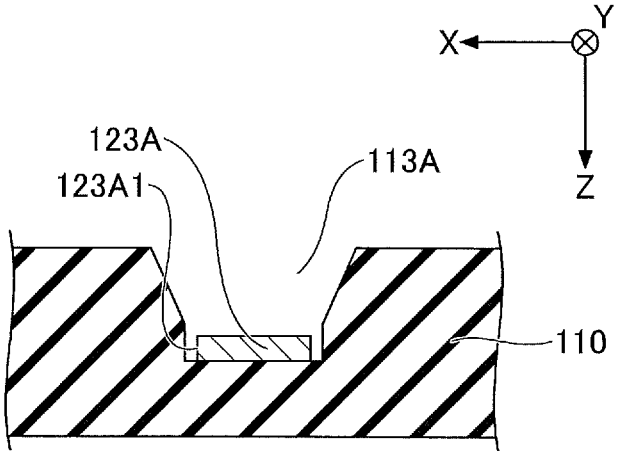
FIG. 4C is a drawing illustrating a cross-sectional structure of the sealing unit 160.
Figure 4D:
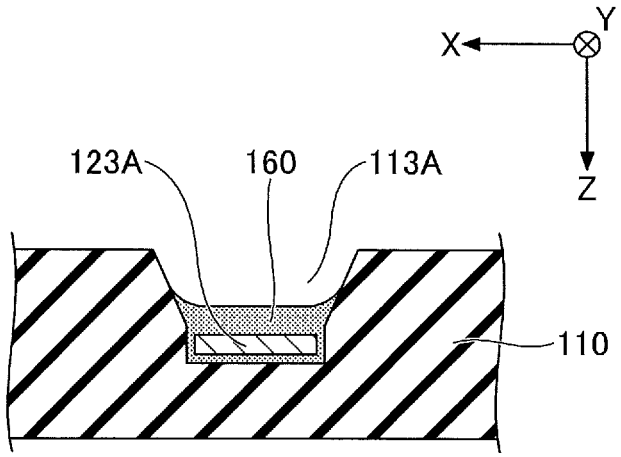
FIG. 4D is a drawing illustrating a cross-sectional structure of the sealing unit 160.

As illustrated in FIG. 4C, the opening 113A may be formed so as to expose side surfaces 123A1 on both sides of the connection portion 123A. In other words, the opening 113A may extend to the space between the housing 110 and the side surfaces 123A1 on both sides of the connection portion 123A. In this manner as described above, as illustrated in FIG. 4D, the sealing unit 160 can be more reliably formed in the gap between the housing 110 and the side surfaces 123A1 on both sides of the connection portion 123A, and this allows the sealing agent to further permeate even the gap between the upper surface and the housing 110.

In the manner as described above, in the switch device 100, the lower surface of the housing 110 is provided with the openings 113A, 113B from which the connection portions 123A, 123B of the metal plates 120A, 120B, respectively, are exposed, and the sealing unit 160 obtained by solidifying the sealing agent injected from the openings 113A, 113B is formed, so that the flux is prevented or inhibited from entering the gap on the side closer to the center fixed contact point 122A and the peripheral fixed contact points 122B than the portion where the sealing unit 160 is formed. Moreover, not only the flux but also foreign substances such as moisture and dust can also be prevented or inhibited from entering the gap.

A contact failure between the center fixed contact point 122A, the peripheral fixed contact point 122B, and the metal contact 130 can be alleviated by preventing or inhibiting foreign substances from entering the center fixed contact point 122A and the peripheral fixed contact points 122B.

Therefore, a switch device 100 in which an electrical contact failure due to entry of foreign substances is prevented or inhibited can be provided.

In the above disclosure, the openings 113A, 113B are arranged at the positions indicated in FIG. 3. However, the positions of the openings 113A, 113B are not particularly limited so long as the openings 113A, 113B are arranged so that the connection portion 123A arranged between the terminal 121A and the center fixed contact point 122A is exposed and so that the connection portions 123B arranged between the terminal 121B and the peripheral fixed contact points 122B are exposed.

In the above disclosure, when the housing 110 and the metal plates 120A, 120B are integrally produced by insert molding, the openings 113A, 113B also serve as holes in which jigs for holding the metal plates 120A, 120B are inserted. However, the openings 113A, 113B do not have to serve as holes in which the jigs are inserted, and the openings 113A, 113B may be dedicated openings for forming the sealing unit 160.

In the above disclosure, the openings 113A, 113B are provided on both of the metal plates 120A, 120B, However, when solder is not used for any one of the terminals 121A, 121B, an opening (113A or 113B) may be provided only for a metal plate (120A or 120B) including a terminal (121A or 121B) using solder.

In the above disclosure, the openings 113A, 113B that allow the entire widths of the connection portions 123A, 123B of the metal plates 120A, 120B to be exposed are provided. However, the opening 113A may be divided into two so that only the portions of the side surfaces (fracture surfaces) on both sides in the direction of the width of the connection portion 123A are exposed, and the central portion in the direction of the width of the connection portion 123A is not exposed. This is also applicable to the opening 113B.

Hereinabove, the switch device according to the exemplary embodiment of the present disclosure has been described above, but the present disclosure is not limited to the embodiment specifically described above, and various modifications and changes can be made without departing from the subject matter described in the claims.

What is claimed is:

1. A switch device comprising:

a housing including a first surface and a second surface, the second surface formed on an opposite side of the housing from the first surface, the housing including a recessed portion recessed in a thickness direction from an opening formed in the first surface;

a metal member provided in the housing by insert molding, the metal member including a terminal protruding to an outside from a first end portion of the housing, a fixed contact point exposed to an inner side of the recessed portion, and a connection portion connecting the terminal and the fixed contact point;

a movable contact point member provided in the recessed portion and configured to move to connect to or disconnect from the fixed contact point, wherein the second surface of the housing is formed with a hole portion that is in communication with the connection portion and has such an opening size as to expose both ends in a width direction of the connection portion, and a sealing unit is provided in a gap between the connection portion and the housing so as to completely seal an entire periphery of the connection portion that is surrounded by the hole portion, said entire periphery including a lower surface that faces the hole portion, an upper surface that is opposite to the lower surface and side surfaces between the upper surface and the lower surface, and the sealing unit is made by solidifying a sealing agent supplied through the hole.

2. The switch device according to claim 1, wherein the sealing unit is also provided in the hole portion.

3. The switch device according to claim 1, wherein the sealing unit is provided in a gap between the housing and a third surface of the connection portion facing the hole portion.

4. The switch device according to claim 3, wherein the sealing unit is further provided in a gap between the housing and side surfaces on both ends in a width direction of the connection portion.

5. The switch device according to claim 4, wherein the sealing unit is further provided in a gap between the housing and a fourth surface of the connection portion on an opposite side of the connection portion from the third surface.

6. The switch device according to claim 4, wherein the third surface of the connection portion and the side surfaces on both ends in the width direction of the connection portion are exposed from the hole portion.

* * * * *